United States Patent [19]

Deragon

[11] 4,355,649

[45] Oct. 26, 1982

[54] PORTABLE TENT FOR MOTORCYCLISTS

[76] Inventor: Allen E. Deragon, Salt Point Rd., Poughkeepsie, N.Y. 12601

[21] Appl. No.: 232,145

[22] Filed: Feb. 6, 1981

[51] Int. Cl.[3] ..... A45F 1/00

[52] U.S. Cl. ..... 135/1 A

[58] Field of Search ..... 135/1 R, 1 A, 7, 3 A, 135/4 A, 7.1 A, 5 A, 14 V, 15 PQ; 150/52 K; 224/30 A; 206/335

[56] References Cited

U.S. PATENT DOCUMENTS

| | | | |
|---|---|---|---|
| 23,582 | 4/1859 | Johns | 135/1 R |
| 460,896 | 10/1891 | Stiter | 135/1 R |
| 518,856 | 4/1894 | Palmer | 135/1 R |
| 1,158,356 | 10/1915 | Wilson | 135/1 R |
| 4,114,633 | 9/1978 | Herbeze | 135/1 A |
| 4,256,321 | 3/1981 | Trulove | 135/3 A |

*Primary Examiner*—Richard C. Pinkham
*Assistant Examiner*—T. Brown
*Attorney, Agent, or Firm*—Spellman & Joel

[57] ABSTRACT

A portable tent arrangement comprises a duffle-type pouch having an axial zipper within which rayon tenting material is packed and affixed at one end to the back of the pouch. The pouch is mounted on the rear of a motorcycle or bicycle which supports the rear of the assembled tent. A smaller zippered pouch extends axially along the side of the larger pouch to accommodate various mounting elements such as tent pegs, adjustable tent rods and a pole and folded plastic battens which are used to provide side support. To assemble the tent, the tenting material is pulled out horizontally from the larger pouch, the rods are inserted into four sewn-in corner pockets at each end of the tent and the hinged battens are unfolded and inserted into four diagonal pouches sewn into the sides of the tenting material to provide side support and shape for the tent. Four small plastic tenting pegs are also supplied within the smaller pouch to provide the final shape and support for the tent. The tenting material also includes a sewn-in back panel and floor, as well as a sewn-in front panel with a nylon zipper. The front of the tent is arranged slightly lower than the back with the adjustable pole to prevent rain from running down into the pouch. The tent is easy to assemble and is taken down by merely removing the pegs, folding the battens, collapsing the rods and pole and then placing the mounting elements into the smaller pouch and stuffing the material back into the main pouch.

7 Claims, 5 Drawing Figures

PORTABLE TENT FOR MOTORCYCLISTS

BACKGROUND OF THE INVENTION

This invention relates to portable tents and particularly to portable tents mounted on motorcycles and used to shelter individuals.

The prior art includes U.S. Pat. No. 4,114,633 to Herbez which discloses a camping tent for motorcycles and cyclists designed in the form of a penthouse mounted against one of the sides of the vehicle. Mounting tubes are provided to support the tent both on the front and rear of the motorcycle. The patent does not disclose a duffle-type pouch with which a tent is mounted and permanently affixed, nor does it disclose an arrangement wherein the tent is positioned at the rear of the motorcycle without the use of mounting tubes which are affixed to the motorcycle itself.

U.S. Pat. No. 3,884,523 to Allen discloses a protective covering for a motorcycle which is contained in a cover storage compartment in the vehicle seat with a portion permanently affixed thereto. The patent is not concerned with a tent or cyclist.

Also of somewhat general interest are U.S. Pat. Nos. 3,800,814 to Hibbert, 1,853,742 to Owen and 3,913,968 to Luppens. The Hibbert patent, for example, discloses a collapsible quonset tent which may be carried within an oblong zippered container. The tent and usage thereof are completely different from the present invention, while the carrying container is clearly of the same general shape. Owen U.S. Pat No. 1,853,742 discloses a rain guard for motorcycles which is mounted on a roller to the rear of the motorcycle seat and pulled outwardly therefrom. Finally, Luppens U.S. Pat. No. 3,913,968 discloses a collapsible camper comprising a collapsible support frame including a front and rear assembly configured to support a tent covering in combination with a bicycle frame. This patent is deemed to be of little interest.

The present invention is an improvement over the prior art noted above in that the tent is of the pump tent type for sheltering cyclists with its longitudinal axis running substantially along the length of the motorcycle and being positioned to the rear thereof. The tenting material is permanently affixed at one end within the duffle pouch so that the rear of the motorcycle provides one of the vertical supports therefor. The tenting material also includes specific pockets to receive adjustable support members which are supplied within an auxiliary pouch running along the length of the main pouch. The invention provides a shelter for a cyclist which occupies a minimum of space when not in use and can be readily assembled and disassembled.

SUMMARY OF THE INVENTION

The present invention relates to portable tents and particularly portable tents for motorcyclists.

In the present invention a portable tent is mounted within a duffle-type pouch to the rear of the motorcycle seat. The portable tent is of the pup tent type with its axis running substantially along the length of the motorcycle and positioned to the rear thereof. The material is permanently affixed in the rear to the duffle pouch to provide the necessary rear support for the tent on the motorcycle. Separate battens, pegs, rods and a tenting pole are provided within an auxiliary pouch so that the tent may be readily assembled by pulling it out from the pouch, inserting the battens in side pockets and the rods in the forward and rear pockets and adjusting the pole in the front of the tent.

The pegs provide added shape and support and the tent is immediately ready for use. By the same token, the tent may be readily collapsed by removing the battens, pegs, rods and tent pole and stuffing the tenting material back into the pouch. The separate elements such as battens, etc., are then inserted into the auxiliary pouch.

Accordingly, an object of this invention is to provide a new and improved portable tent for motorcyclists.

Another object of this invention is to provide a new and improved portable tent which is mounted on a motorcycle and may be readily assembled using the vehicle as a support.

A further object of this invention is to provide a unique portable tent which is permanently affixed at one end within a duffle-type pouch and is readily removable therefrom for assembly purposes.

A more specific object of this invention is to provide a new and improved portable tent for cyclists which is mounted to the cycle at one end for spport and includes additional adjustable support means for rapidly assembling the tent to the rear of the cycle, all mounted within a main and auxiliary pouch on the cycle.

BRIEF DESCRIPTION OF THE DRAWINGS

Other objects and advantages of the present invention may be seen from the following description when viewed in conjunction with the accompanying drawings wherein.

DETAILED DESCRIPTION OF THE INVENTION

Figure 1:
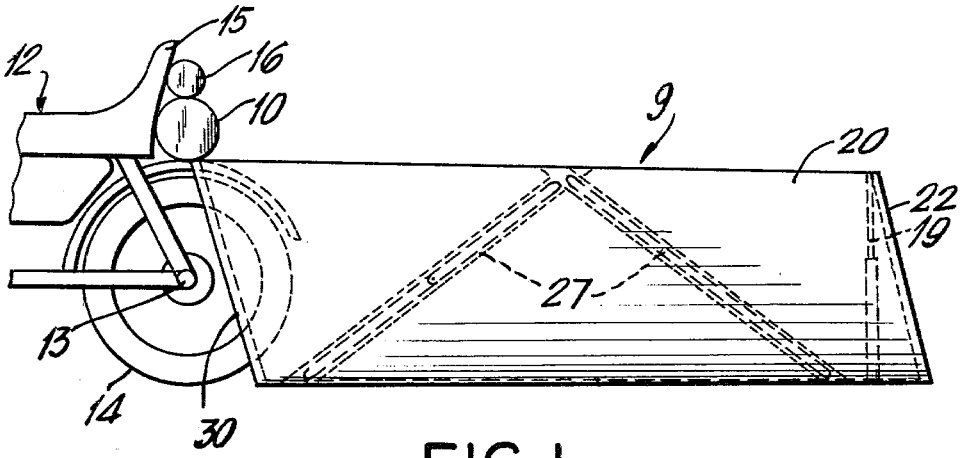
FIG. 1 is a side view of the tent in an assembled condition extending rearwardly from a motorcycle with certain elements shown in phantom.
Figure 2:
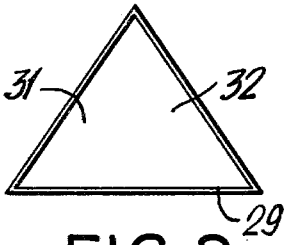
FIG. 2 is an end view of the tent in an assembled condition.
Figure 3:
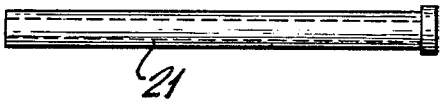
FIG. 3 is a view of a telescoping adjustable rod used to support the end of the tent.
Figure 4:
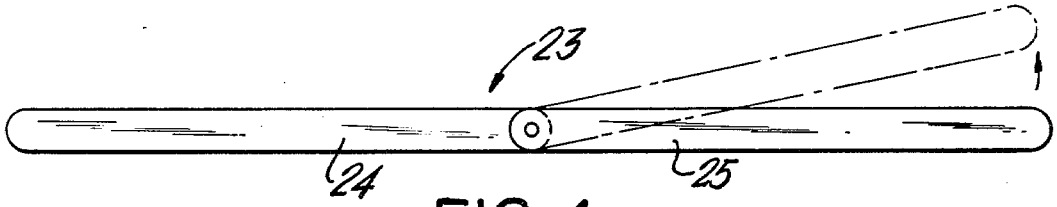
FIG. 4 is a side view of an adjustable batten used to support the side of the tent.
Figure 5:
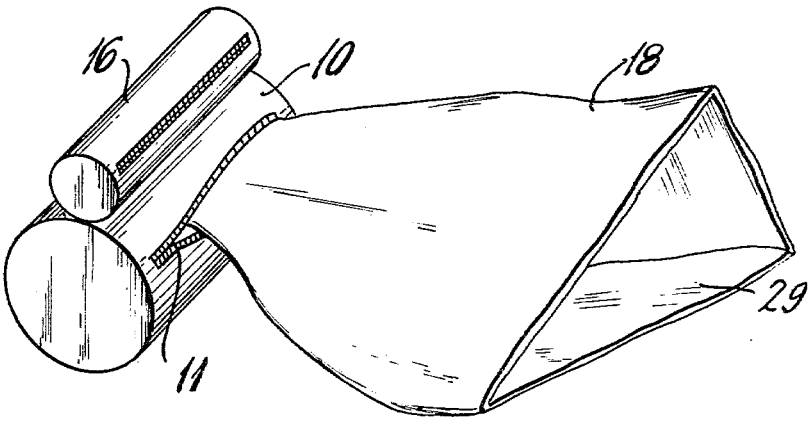
FIG. 5 is a perspective view of the pouches containing the tent and mounting elements which are mounted on the rear of the motorcycle behind the seat.

Referring now to the drawings, the invention comprises a portable tent 9 for motorcyclists, etc. The tent 9 is mounted within a substantially oval pouch 10 having a zipper 11 extending axially therealong. In a preferred embodiment, the pouch 10 is approximately 18 inches in length and is mounted to the rear of a motorcycle 12 as shown in FIG. 1. Conventional straps, etc., (not shown) may be used to secure the pouch 10 over the center 13 of the rear wheel 14 and behind the motorcycle seat 15. The pouch 10 includes a smaller pouch 16 which is affixed along the length of the pouch 10 and includes a zipper 17 extending axially therealong.

The pouch 10 contains rayon tenting material 18 which is extractable through the zippered opening 19 and is permanently affixed at one end to the rear of the pouch 10. In other words, the tenting material 18 may be pulled outwardly from the pouch 10 in parachute fashion and readily assembled into a tent 9 using the motorcycle 12 as a rear support. Similarly, the tent 9 may be readily collapsed by removing the supporting elements described below, and stuffing the tenting material 18 back into the pouch 10.

The smaller pouch 16 accommodates adjustable rods 21 for the front and rear edges of the tent 9 and an adjustable tent pole 19. The rods 21 and the pole 19 are of a telescoping type so that they can be raised beyond their 18 inch storage height. The rods 21 support the front and rear edges of the tent within sewn-in support pockets 22 in the tenting material 18. The tent pole 19 is conventionally positioned at the entrance to the tent 9 and is adjusted to a height slightly lower than the rear of the tent 9 so that water does not run back into the pouch 10.

The smaller pouch 16 also includes four folding battens 23 of a plastic material each comprising a pair of elongated members 24 and 25 which are pinned at a central point 26. The elongated members of each pair may be folded over about point 26 into a juxtaposed position so that the battens 23 may be packed away in pouch 16. Finally, the smaller pouch 16 also includes four pegs 13 for providing support and shape to the tent 9 at the corners thereof.

The tent 9 is generally of the pup tent type and includes sewn-in pockets 27 on each side extending from both the front and rear ends towards the upper ridge 28 thereof at a central point. In use, the extended battens 23 are mounted within said pockets 27 to provide support for the tent sides.

The tent 9 also includes a sewn-in floor 29 and rear flap 30 as well as zippered front flaps 31 and 32 which extend outwardly from the sides.

In operation, the pouch 10 is unzippered and the tenting material 18 is pulled outwardly from the pouch 10 at the rear of the motorcycle 12. The battens 23 and adjustable rods 21 are removed from the smaller pouch 16, adjusted to their proper lengths and then inserted into the respective pockets 27 and 22. The tent pole 19 is adjusted to its desired height and conventionally positioned at the front of the tent 9. The tent pegs 33 are then mounted at the corners of the tent 9 to provide added support and shape.

The rear of the motorcycle provides a support for the rear of the tent 9 at a somewhat higher elevation than the front so that rain is deflected away from the motorcycle pouch 10. As a further advantage, an additional support can be provided to quickly replace the motorcycle support if it is desired to drive the motorcycle away. The motorcycle can also be returned to its initial position if desired by removing the support. The entire assembly operation may be performed quite expeditiously and disassembly of the tent is also quite simple and fast. It is estimated that the entire operation would take no more than 5 minutes.

It is understood that the above-described arrangements are merely illustrative examples of the application. Numerous other arrangements may be readily devised by those skilled in the art which will embody the principles of the invention and fall within the scope and spirit thereof.

I claim:

1. A portable tent for use with motorcycles and the like and being mounted to said motorcycle comprising:

a main pouch having a substantially oval configuration and including a zipper mounted axially along the length thereof and a secondary oval pouch of a smaller size being affixed along the length of the main pouch and having a zipper running axially along the length thereof, said main pouch being mountable on the rear of a motorcycle, a sheet of tenting material having a plurality of sewn-in pockets along the tent edges thereof and in predetermined intermediate locations on the sides, said sheet being normally packed within the main pouch and extractable therefrom to form a tent extending rearwardly from the motorcycle, a plurality of adjustable battens being mounted in the smaller pouch and each being insertable in a corresponding side pocket in the sheet of tenting material at intermediate locations on each side of said tent to provie shape and support thereto, a plurality of adjustable rods being insertable in the end pockets in the sheet of tenting material and being normally contained in the secondary pouch, and, an adjustable pole being positioned to engage the sheet of tenting material at the front end thereof to form a vertical support together with the motorcycle, said pole being normally contained in said pouch.

2. A portable tent in accordance with claim 1 wherein:

the sheet of tenting material includes a pair of front flaps extending from the front edge thereof forming the entrance to the tent, a rear flap extending from the rear tent edge thereof, an integral floor along the base of the tent and a rear portion afixed within the main pouch to provide vertical support for the tent at one end.

3. A portable tent in accordance with claim 2 wherein:

the battens each comprise a pair of elongated members being pinned together at one end thereof and foldable into a substantially parallel arrangement to fit into the smaller pouch, and wherein four battens are provided for insertion into the side pockets.

4. A portable tent in accordance with claim 2 wherein:

the rods and the pole each comprise an elongated telescoping element which is retractable to fit into the smaller pounch and wherein four rods are provided for insertion into pockets on the tent edges.

5. The portable tent in accordance with claim 2 wherein:

the side pockets comprise four envelopes in the tenting material extending on each side from approximately the base at each end to approximately the center of the material at a point adjacent to the top of the tent.

6. A portable tent in accordance with claim 2 further including:

four pegs normally contained in the auxiliary pouch and each being mountable in a corner of the tent for support purposes.

7. A portable tent in accordance with claim 2 further including:

an adjustable pole for providing vertical support for the tent when the motorcycle is removed, said pole being normally carried in the main pouch and being readily substituted for the motorcycle support.

* * * * *